US006100673A

United States Patent [19]

Bair, III et al.

[11] Patent Number: 6,100,673

[45] Date of Patent: Aug. 8, 2000

[54] VOLTAGE CONTROL DEVICE FOR INCREASING OR DECREASING VOLTAGE TO A LOAD

[75] Inventors: Richard H. Bair, III, Asheville; Bryan Morgan Elwood, Candler; Steven Michael Region, Weaverville, all of N.C.

[73] Assignee: SPX Corporation, Muskegon, Mich.

[21] Appl. No.: 09/275,931

[22] Filed: Mar. 24, 1999

[51] Int. Cl.[7] ..... G05F 1/14

[52] U.S. Cl. ..... 323/255; 323/340

[58] Field of Search ..... 323/255, 258, 323/247, 257, 259, 340, 344

[56] References Cited

U.S. PATENT DOCUMENTS

| | | | |
|---|---|---|---|
| 4,178,539 | 12/1979 | Crapo . | |
| 4,716,357 | 12/1987 | Cooper . | |
| 5,155,672 | 10/1992 | Brown | 363/43 |
| 5,550,459 | 8/1996 | Laplace | 323/255 |
| 5,712,554 | 1/1998 | Lace . | |
| 5,808,454 | 9/1998 | Chung | 323/255 |
| 5,821,739 | 10/1998 | Imoto | 323/258 |
| 5,825,164 | 10/1998 | Williams | 323/255 |

*Primary Examiner*—Adolf Deneke Berhane
*Attorney, Agent, or Firm*—Hovey, Williams, Timmons & Collins

[57] ABSTRACT

A voltage control apparatus (10) selectively boosts or bucks an input voltage in order to provide a selected output voltage. In the preferred embodiment, the apparatus includes a transformer (T1) having a plurality of secondary voltages presented at respective output connections (A–E), a connection circuit (12) having actuatable connection elements (R1–R6) to interconnect selected ones of the output connections, and a control circuit (14) operable to sense the input voltage at the primary of the transformer (T1) and to activate selected ones of the connection elements to produce a selected output voltage for delivery to a load. The preferred connection elements include electro-mechanical relays.

14 Claims, 1 Drawing Sheet

VOLTAGE CONTROL DEVICE FOR INCREASING OR DECREASING VOLTAGE TO A LOAD

RELATED APPLICATIONS

Not applicable.

FEDERALLY SPONSORED RESEARCH OR DEVELOPMENT

Not applicable

MICROFICHE APPENDIX

Not applicable.

BACKGROUND OF THE INVENTION

1. Field of the Invention

The present invention relates to the field of voltage control devices. In particular, the invention is concerned with a voltage control apparatus using a transformer with a plurality of secondary output connections coupled with electromechanical relays controlled by a control circuit in order to provide a selected output voltage to a load.

2. Description of the Prior Art

One of the typical design assumptions for motor-driven equipment is that the line voltage supplied to the load such as a motor will be in a certain range. However, local conditions may result in line voltages outside the range for which the equipment was designed. Such can occur because of brownout conditions, inadequate supply capacity, and other loads on a supply circuit. High voltage conditions may also occur because of inadequate line regulation.

Both high and low voltage conditions can contribute to poor performance of the equipment and can even result in motor burnouts and the like. Such can be especially problematic for critical applications such as cryogenic preservation equipment.

SUMMARY OF THE INVENTION

The present invention solves the prior art problems mentioned above and provides a distinct advance in the state of the art. In particular, the voltage control apparatus of the present invention provides output voltage to a load at a selected level despite variations in the input voltage from the supply source.

The preferred voltage control apparatus selectively boosts or bucks an input voltage in order to provide a selected output voltage. The apparatus includes a transformer having a plurality of secondary voltages presented at respective output connections, a connection circuit having actuatable connection elements to interconnect selected ones of the output connections, and a control circuit operable to sense the input voltage at the primary of the transformer and to activate selected ones of the connection elements to produce a selected output voltage for delivery to a load. The preferred connection elements include electromechanical relays. Other preferred aspects of the present invention are disclosed herein.

BRIEF DESCRIPTION OF THE DRAWINGS

The single drawing figure.

DETAILED DESCRIPTION OF THE PREFERRED EMBODIMENT

Figure 1:
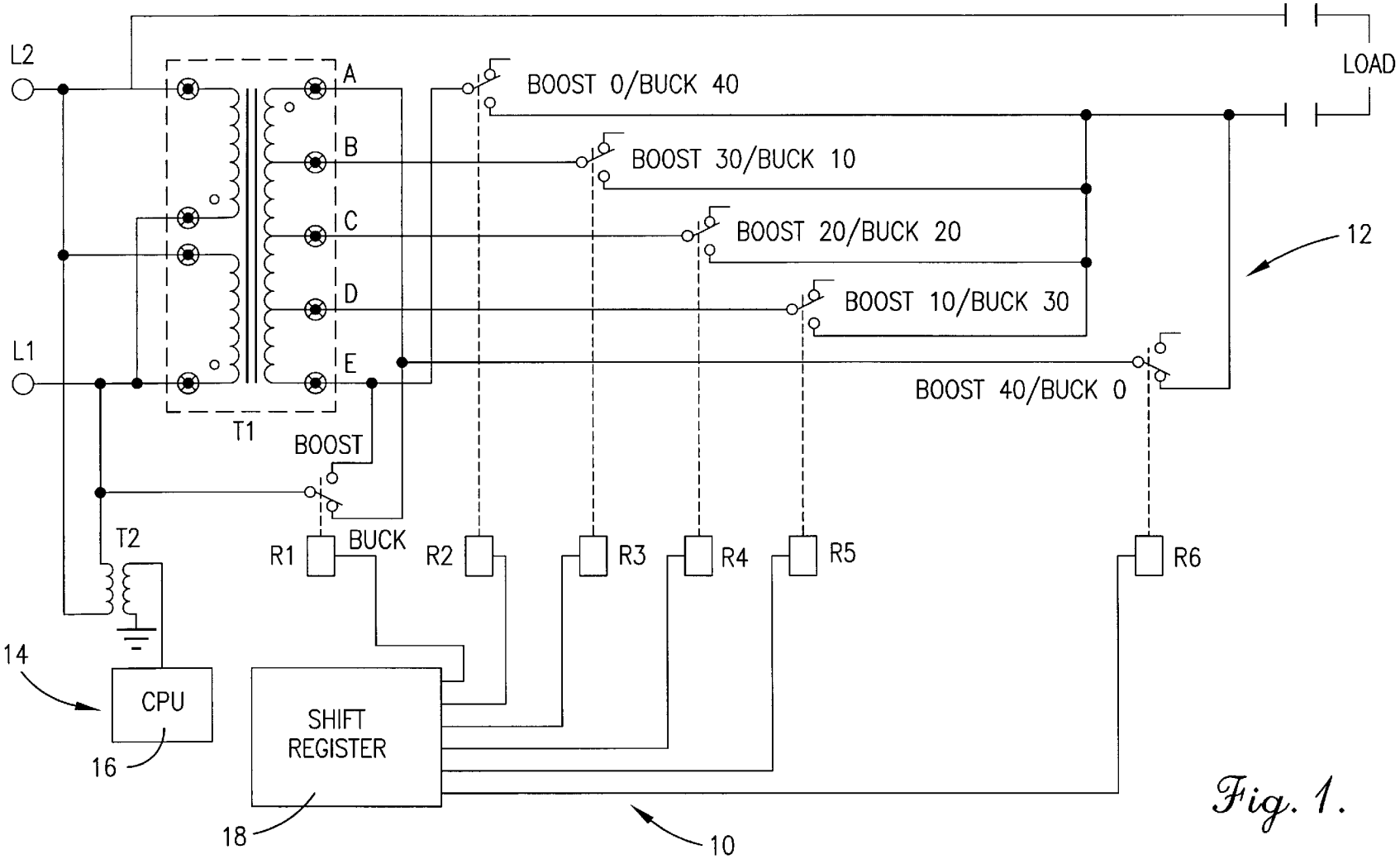
FIG. 1, is an electrical diagram illustrating the preferred voltage control apparatus of the present invention.

Referring to the drawing figures, voltage control apparatus 10 in accordance with the present invention includes transformer T1, connection circuit 12 and control circuit 14. Transformer T1 includes dual primary windings each connected to input voltage at terminals L1 and L2, and includes a secondary winding have 5 taps providing a plurality of secondary voltages at output connections A, B, C, D and E. With an input voltage of about 100 volts, each tap of the secondary winding provides an output at about 10 volts for a total buck or boost capacity of about 40 volts. Transformer T1 is used in an autotransformer configuration.

Connection circuit 12 includes electromechanical relays R1, R2, R3, R4, R5 and R6 having respective coils and having respective contacts shown in the de-energized position in FIG. 1. The contacts of relays R1–R6 selectively interconnect output connections A–E and terminal L1 with the load.

Control circuit 14 includes sensing transformer T2, central processing unit (CPU) 16 and shift register 18 (type UCN5891). Sensing transformer T2 is connected between terminals L1 and L2 to receive input voltage as a reference voltage. The output from sensing transformer T2 is stepped down and rectified to provide a corresponding DC reference voltage to CPU 16. CPU 16 preferably includes a microcontroller under computer program control, receives the DC reference voltage as input, and provides 8-bit data outputs to shift register 18 which, in turn, is connected to the coils of relays R1–R6 for selective actuation thereof.

In operation, CPU 16 determines from the reference voltage whether the input voltage at terminals L1, L2 is above or below about 178 VAC. If below 178 VAC, this is an indication that the load was designed for a regulated supply voltage between about 103 and 110 VAC which is the targetted load supply voltage for typical household supply voltage in the United States, for example. If the reference voltage is above 178 VAC, this is an indication that load was designed for supply voltage between about 208 and 216 VAC which is typical for Europe and other countries. In this way, apparatus 10 can be standardized and supplied for equipment designed for operation in virtually any location.

CPU 16 then determines whether the input voltage at terminals L1, L2 is in the desired range, e.g., 103–110 VAC, for the load. If yes, then no buck or boost is required, CPU 16 provides no output to shift register 18 and all of the relay coils are de-energized as shown in FIG. 1. In this situation, line voltage from terminals L1, L2 is supplied as the output voltage to the load. In particular, terminal L1 is connected through the contact of relay R1 to the contact of relay R6 which in turn is connected to the load. In the autotransformer configuration, the other side of the load is connected to terminal L2. This configuration also functions as a fail-safe arrangement. That is, if control circuit 14 is inoperative, the normally closed contacts of relays R1 and R6 provide line voltage directly to the load without any conditioning or regulation.

If the input voltage is below the desired range, CPU 16 then determines how much boost is needed to supply the load with voltage in the desired range. For example, if a 10 volt boost is needed, CPU 16 provides data to shift register 18 in order to actuate relay R1, which shifts its contact to the boost position. This is the status for relay R1 whenever a voltage boost is needed. This also places transformer T1 in the desired autotransformer configuration. In addition, CPU 16 provides data to shift register 18 in order to actuate relay R5 to connect output connection D to the load for a 10 volt boost.

For a 20 volt boost, CPU provides data to actuate relay R4 to couple output connection C to the load. Similarly, for a 30 volt boost, relay R3 is actuated to couple output connection B with the load, and for a 40 volt boost, relay R6 is actuated to couple connection A with the load.

If the input voltage at terminals L1, L2 is above the desired range, then a voltage buck, i.e. reduction, is needed.

If this is the case, CPU 16 maintains relay R1 in the de-energized state which also places transformer T1 in the desired autotransformer configuration for a voltage buck. For a 10 volt buck, CPU 16 actuates relay R3 to couple output connection B with the load. For a 20 volt buck, relay R4 is actuated to couple output connection C. Similarly, relay R5 is actuated to couple output connection D to the load for a 30 volt buck, and relay R2 is actuated to couple output connection E for a 40 volt buck.

Apparatus 10 operates in a similar manner for maintaining the output voltage in the range between 208 and 216 VAC for an input voltage above 178 VAC. It will now be appreciated that apparatus 10 provides for automatic boost or buck in order to maintain the output voltage to the load within the specified range.

As those skilled in the art will understand, the present invention encompasses many variations of the preferred embodiment as disclosed herein. For example, power transistors or other solid state components could be used in place of the preferred of the electromechanical relays. Also, various types of transformers can be used with output taps configured as needed for greater or lesser boosts and bucks in the output voltage and with different increments as needed. Having thus described the preferred embodiment of the present invention the following is claimed as new and desired to be secured by Letters Patent:

What is claimed is:

1. A voltage control apparatus for controlling voltage delivered to a load, said apparatus comprising:

a transformer including primary connections to connect to a source of power at an input voltage, and including a plurality of output connections, said transformer being configured to present a plurality of secondary voltages at said output connections in response to input voltage;

a connection circuit coupled with said transformer and configured to couple said transformer with a load so as to provide one of a buck or a boost in voltage delivered to said load, said connection circuit including a plurality of selectable, actuatable connection elements operable to interconnect selected ones of said output connections with said load; and a control circuit coupled with said connection circuit and coupled with said transformer to sense one of said voltages as a reference voltage and responsive thereto to actuate selected ones of said connection elements to produce a selected output voltage from said secondary voltages including one of a buck or a boost of said input voltage for delivery to a load.

2. The apparatus of claim 1, said connection elements including electromechanical relays.

3. The apparatus of claim 1, said connection elements including a plurality of electromechanical relays corresponding to and coupled with respective output connections of said transformer.

4. The apparatus of claim 1, said control circuit being operable to sense whether said input voltage exceeds a predetermined level and, in response, to actuate selected ones of said selected ones of said connection elements to produce said output voltage in a first range, and to sense whether said input voltage is below said predetermined level and, in response, to actuate said selected ones of said connection elements to produce said output voltage in a second range.

5. The apparatus of claim 4, said predetermined level being about 180 VAC, said first range being between about 208 and 216 VAC, said second range being between about 103 and 110 VAC.

6. The apparatus of claim 1, said control circuit including a microprocessor.

7. The apparatus of claim 6, said reference voltage including said input voltage, said control circuit including a sensing transformer coupled between said primary connections and said microprocessor, and further including a shift register coupled between said microprocessor and said connection elements.

8. The apparatus of claim 1, said reference voltage including said input voltage.

9. The apparatus of claim 1, said transformer presenting an autotransformer configuration.

10. The apparatus of claim 1, said selected output voltage from said secondary voltages including one of a boost and buck of said input voltage by about 40 volts.

11. The apparatus of claim 10, said secondary voltages including increments of about 10 volts.

12. A voltage control apparatus for controlling voltage delivered to a load, said apparatus comprising:

a transformer including primary connections to connect to a source of power at an input voltage, and including a plurality of output connections, said transformer being configured to present a plurality of secondary voltages at said output connections in response to input voltage;

a connection circuit coupled with said transformer and configured to couple with a load, said connection circuit including a plurality of selectable, actuatable connection elements operable to interconnect selected ones of said output connections; and a control circuit coupled with said connection circuit and coupled with said transformer to sense one of said voltages as a reference voltage and responsive thereto to actuate selected ones of said connection elements to produce a selected output voltage from said secondary voltages for delivery to a load, said connection elements including a plurality of electromechanical relays corresponding to and coupled respectively with said output connections, said control circuit including a microprocessor, said reference voltage including said input voltage, a sensing transformer coupled between said primary connections and said microprocessor for delivering a stepped down sensed voltage to said microprocessor, and a shift registered coupled between said microprocessor and said electromechanical relays for selective actuation thereof, said microprocessor being operable to sense whether said input voltage exceeds a predetermined level and in response to actuate selected ones of relays to produce said output voltage in a first range, and to sense whether said input voltage is below said predetermined level and in response to actuate selected ones of said relays to produce said output voltage in a second range, said selected output voltage from said secondary voltages including one of a boost and a buck of said input voltage.

13. The apparatus of claim 12, said predetermined level being about 180 VAC, said first range being between about 208 and 216 VAC, said second range being between about 103 and 110 VAC.

14. The apparatus of claim 13, said one of a buck and boost of said input voltage including about 40 volts in increments of about 10 volts.

* * * * *